United States Patent [19]

Verble

[11] Patent Number: 4,658,558

[45] Date of Patent: Apr. 21, 1987

[54] APPARATUS FOR ATTACHING ROOFING MEMBRANE TO A STRUCTURE

[75] Inventor: Patrick R. Verble, Fortville, Ind.

[73] Assignee: North American Roofing Company, Inc., Carmel, Ind.

[21] Appl. No.: 865,765

[22] Filed: May 22, 1986

[51] Int. Cl.[4] ..... E04D 5/14

[52] U.S. Cl. ..... 52/410; 52/698; 411/431

[58] Field of Search ..... 52/410, 63, 96, 506, 52/512, 509, 698; 411/372–377, 368, 429, 431, 508–510, 531, 533, 910

[56] References Cited

U.S. PATENT DOCUMENTS

| | | | |
|---|---|---|---|
| 4,380,413 | 4/1983 | Dewey | 52/410 |
| 4,394,096 | 7/1983 | Stevens | 411/910 |
| 4,455,804 | 6/1984 | Francovitch | 52/698 |
| 4,502,256 | 3/1985 | Hahn | 52/63 |
| 4,519,175 | 5/1985 | Resan | 52/713 |
| 4,520,606 | 6/1985 | Francovitch | 52/410 |
| 4,543,758 | 10/1985 | Lane | 52/410 |
| 4,586,301 | 5/1986 | Hickman | 52/96 |

FOREIGN PATENT DOCUMENTS

| | | |
|---|---|---|
| 1609328 | 4/1970 | Fed. Rep. of Germany . |
| 2330901 | 6/1977 | France . |

*Primary Examiner*—J. Karl Bell

*Attorney, Agent, or Firm*—Woodard, Weikart, Emhardt & Naughton

[57] ABSTRACT

A roof membrane anchoring system in accordance with the present invention includes an anchoring plate with a substantially planar bottom surface and convexly radiused top surface that can be attached to an existing structure. The anchoring plate is disk-shaped and has a cylindrical axial opening in the center into which a lip and a bottom flange extend to form a channel. A cap with a resilient cylindrical body having V-shaped flanges at the bottom and either a disk or ring attached to the top is inserted into the anchoring plate once a roofing membrane is inserted into the axial opening in the plate. The resilient cylindrical body has a cylindrical cavity therein and compression cuts which extend through the body and to the V-shaped flange to allow for the resilient body to assume a first state wherein the greatest diametrical dimension of the resilient cylindrical body and the V-shaped flange is slightly less than the inside diameter of the lip extending into the axial opening. These compression cuts then allow the body to expand to a first state wherein diametrical dimension of the resilient body is slightly less than the inside diameter of the lip which extends into the axial opening. One modification of the anchoring system is to use a plug which may be inserted into the cap after the cap has assumed its first state so that the cap is locked into the first state and cannot inadvertently be removed from the anchoring plate.

20 Claims, 11 Drawing Figures

APPARATUS FOR ATTACHING ROOFING MEMBRANE TO A STRUCTURE

BACKGROUND OF THE INVENTION

This invention relates to an apparatus for attaching roofing membrane to a structure, and more particularly to an apparatus that does not require puncturing of the roofing membrane.

There are a wide variety of roofing systems used for various types of buildings. For larger buildings with generally flat roof surfaces or domed surfaces, flexible sheet material, for example, EPDM rubber membrane, is becoming increasingly popular due to its many well known advantages. This membrane-type roofing is attached to the structure by basically four different systems. The first system is an adhered system wherein the entire surface is coated with suitable cement and the membrane is then stretched across the surface with separate layers of membrane being overlapped and cemented to form a water-tight barrier. This system is very time consuming and expensive due to the cost of cement and the labor in applying the cement. In the partially adhered system bonding takes place at only special plate areas and at the overlap between the sheeting material. This system suffers from many of the same deficiencies as the adhered system. In a ballast system, membrane is laid on top of the roof and a layer of small stones is placed across the roof to hold the membrane to the roof. There are two separate types of mechanically fastened systems. One system incorporates battens which are arranged over the overlapping portions of the sheeting material and then secured to the roof with a layer of membrane being placed over the battens and adhered to the batten and the underlying membrane to form a water-tight barrier. A second type of mechanical fastening system incorporates anchors which are spaced across the roof and the membrane is then anchored at specific locations to the roof. Many of these anchoring systems require penetration of the roof membrane in the process of anchoring the membrane to the structure. Thus, an additional sealing component must be added increasing the time and expense necessary for attaching the membrane to the roof. Some anchoring systems have been adapted to eliminate the need for penetrating the roofing membrane. However, these anchoring systems are either complicated and require hardware that must be manufactured at considerable expense or can be easily damaged when workers are required to walk across the roof.

Various methods and devices for attaching roofing membrane to a structure are disclosed by the following group of patent references. Each reference pertains in one way or another to attaching roofing membrane to a surface though some references are believed to be more relevant to the present invention than others. It is believed by the applicant that the following references are illustrative of the many anchoring systems currently available.

| Pat. No. | Patentee |
|---|---|
| 4,519,175 | Resan |
| 4,543,758 | Lane |
| 4,502,256 | Hahn |
| 4,520,606 | Francovitch |
| 4,455,804 | Francovitch |
| 1,609,328 | Fed. Rep. of Germany |

-continued

| Pat. No. | Patentee |
|---|---|
| 2,330,901 | France |

Resan discloses a lubricated roofing membrane fastener which does not require that the roofing membrane be penetrated in order to attach it to the structure. However, Resan does not disclose the precise invention claimed in this application and suffers from being easily tripped over or having the cover 35 kicked off when workers are required to cross the roof.

Lane discloses a rail and can strip for securing rubber roof membrane to a deck without fastener penetrations. Lane appears to be a combination of a batten system and anchor system. The only relevancy to the present invention is that no penetration of the membrane is required.

Hahn discloses an arrangement for securing a flexible web to a walling means. The invention disclosed in Hahn does not require penetration of the flexible web and that is believed to be the extent of the relevancy to the present invention. Hahn requires a substantial portion of the anchoring means to remain above the web material allowing the anchor to be damaged or tripped over when workers are required to walk across the roof.

Francovitch '606 discloses a roof membrane and anchoring system using dual anchor plates. FIGS. 5–9 disclose anchoring mechanisms which do not require the penetration of the roofing membrane. Also Francovitch discloses a low profile anchoring systems which, to a certain extent, alleviates some of the problems inherent with other anchoring systems.

Francovitch '804 discloses a membrane anchor. The relevancy of '804 is believed to be limited to disclosure of a plate in FIGS. 1–5 which has the same general outward shape as the anchoring plate component of the present invention.

The German patent discloses a wide variety of methods and apparatus for anchoring sheet type roofing. FIG. 9 illustrates a three-part device which does not require penetration of the roofing membrane. However, it appears the device must be inserted in a bore drilled into the roofing surface and therefore would require substantial time in placing the device. Additionally, the device disclosed in FIG. 9 does not incorporate the use of compression cuts in order to ease the insertion of the cap within the anchor plate.

The French patent illustrates an anchoring mechanism which uses a cap that is inserted into a hole in the structure with the cap being compressible to be inserted into the hole and then expandable to remain secured within the hole. The French patent requires a large hole to be drilled or bored in the existing structure so that any failure of the anchoring mechanism would almost invariably lead to leaks in the roof of the structure.

From the foregoing, it is clear that none of the references cited specificaly solves all of the problems inherent in anchoring mechanisms for roofing systems. Additionally, none of the cited references either incorporate or suggest the combination of all of the elements of the present invention.

SUMMARY OF THE INVENTION

One embodiment of the present invention is an apparatus for attaching roofing membrane to a structure which uses a disk-shaped anchoring plate with a flat bottom and a radiused top which is attached directly to the structure. There is an axial opening in the radiused top with a lip and a flange extending into the opening to form a channel within the opening. The membrane is then laid over the anchoring plate with a portion of the membrane inserted in the axial opening and then a cap is inserted in the opening to secure the membrane to the anchoring plate without causing penetration of the membrane. The cap has a disk-shaped top and a cylindrical body with V-shaped flanges at the bottom of the body. Compression cuts are made through the cylindrical body and the V-shaped flanges to allow the cylindrical body to be compressed from a first state, wherein the outside diameter of the cylindrical body is slightly less than the inside diameter of the lip in the axial opening of the anchoring plate, to a second state, wherein the greatest diametrical dimension of the cylindrical body and the V-shaped wedge is slightly less than the inside diameter of the lip in the axial opening in the anchoring plate. When the cap is inserted into the anchoring plate, the cylindrical body again conforms to the first state. One variation of the present invention incorporates an cavity which extends through the cylindrical body and the disk to form a ring type cap which is inserted into the anchoring plate and then a plug having a diameter approximately equal to the diameter of the cylindrical opening is inserted into the ring cap thereby locking the cylindrical body in the first state.

One object of the present invention is to provide a low profile system for attaching roofing membranes to structures which does not allow for the attachment means to be easily damaged by workers walking on the roof.

A second object of the present invention is to provide a system for attaching roofing membrane to an existing structure which does not require penetration of the membrane.

A further object of the present invention is to provide a low cost and economical system for attaching roofing membrane to an existing structure.

Yet another object of the present invention is to provide a system for attaching roofing membrane to an existing structure which does not require extensive modification to the existing structure.

Related objects and advantages of the present invention will be apparent from the following description.

DESCRIPTION OF THE PREFERRED EMBODIMENT

Figure 1:
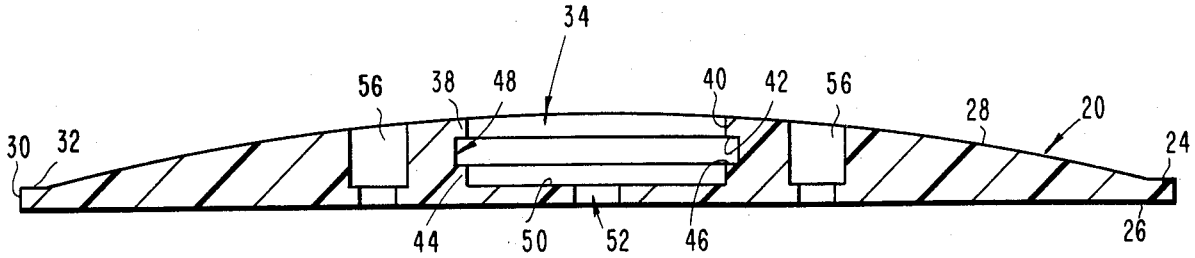
FIG. 1 is a cross-sectional view of an anchoring plate in accordance with the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
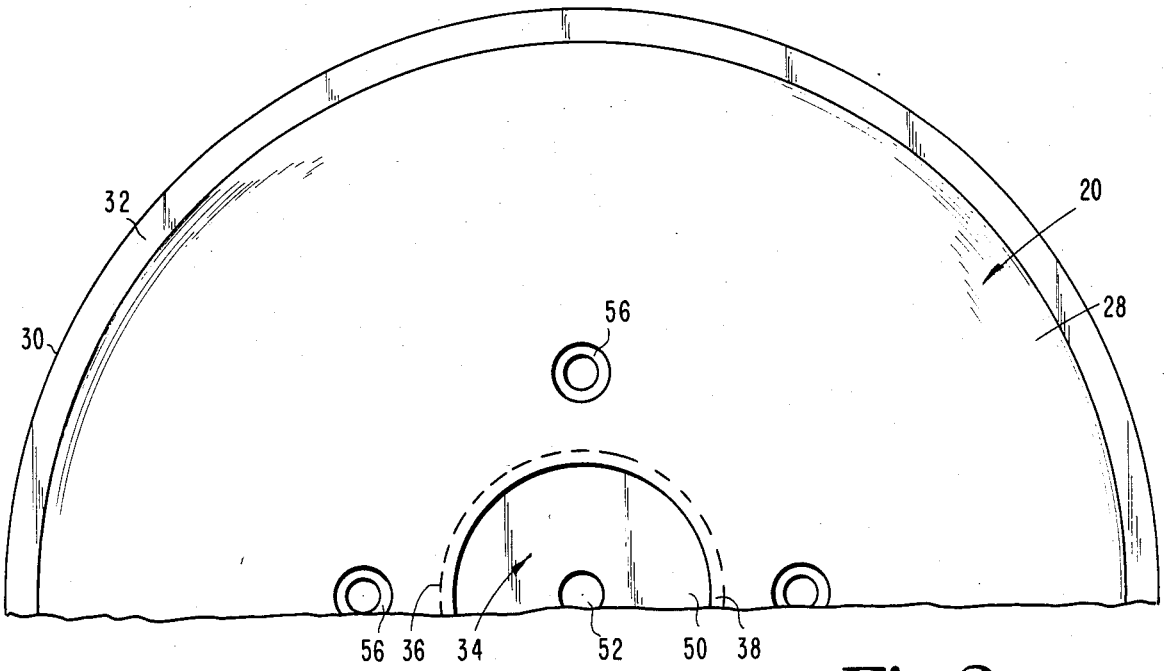
FIG. 2 is a partial top view of the anchoring plate of FIG. 1.

Referring to FIGS. 1, 2, 9 and 10, there is illustrated an anchoring plate 20 for attachment to a structure 22 (FIGS. 9 and 10) such as the roof of a large building. Anchoring plate 20 is a disk 24 with a substantially planar bottom surface 26 and a radiused top surface 28. As can be seen from the drawings, the top surface is convexly radiused so that there is a substantially thicker center portion with the anchoring plate 20 being thinner near the peripheral edge 30. Extending circumferentially around the peripheral edge is a thin planar ring 32 which extends between the peripheral edge 30 and peripheral edge of the radiused top surface 28. There is an axial opening 34 at the center of anchoring plate 20 which is cylindrical. For purposes of convenience in describing the invention, axial opening 34 is defined as that part of the opening at the center of disk 24 with the greatest inside diameter. If axial opening 34 extended through the top surface with no structure extending into the axial opening, it would appear from the top view to be illustrated as dotted line 36 in FIG. 2. However, axial opening 34 does not extend through the radiused top surface 28 as a lip 38 extends radially into axial opening 34 from the radiused top surface 28. Lip 38 extends into axial opening 34 around the entire circumference of axial opening 34 as is best illustrated in FIG. 2. Lip 38 has a cylindrical side surface 40 and a ring shaped bottom surface 42. Also extending radially into axial opening 34 is a bottom flange 44. Bottom flange 44 has a ring-shaped top surface 46. Therefore, it should be understood that bottom flange 44 extends radially into axial opening 34 around the entire circumference of axial opening 34. A channel 48 is defined by ring-shaped bottom surface 42 of lip 38, ring-shaped top surface 46 of bottom flange 44 and radial axial opening 34. Extending through the lower surface 50 of axial opening 34, there is an axial attachment hole 52 through which an appropriate linear fastener 54 (FIGS. 9 and 10) may be inserted to attach anchoring plate 20 to structure 22. It should be understood that the choice of linear fastener 54 will depend upon the type of structure to which the anchoring plate is to be attached. Among the typical types of linear fasteners 54 are nails, screws, and rivets, however, any appropriate linear fastener for the type of structure 22 may be incorporated. A plurality of alternate attachment holes 56 are also provided.

Figure 3:
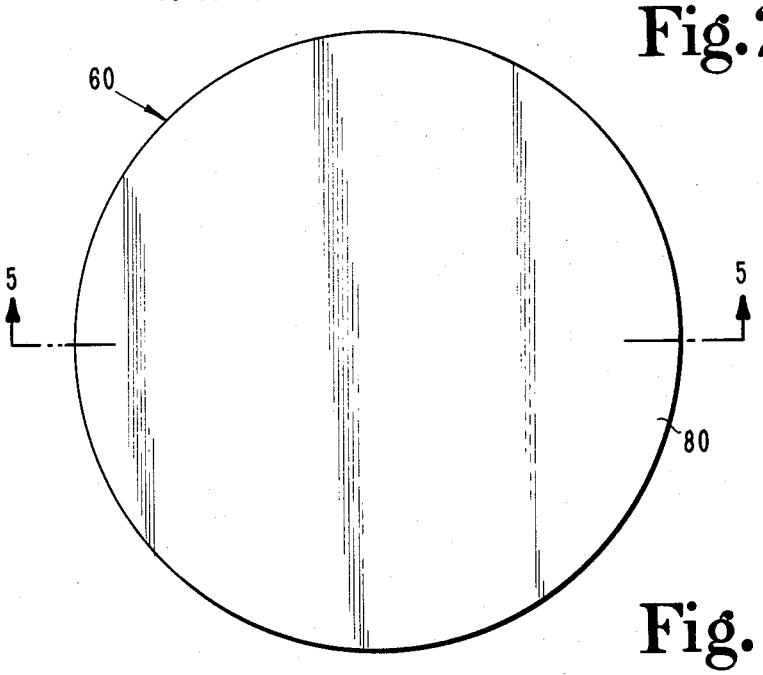
FIG. 3 is a top view of a first cap in accordance with the present invention.
Figure 4:
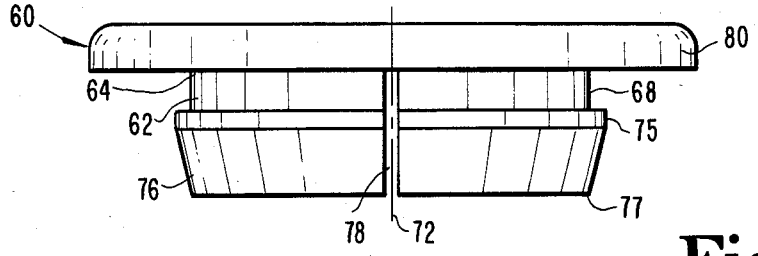
FIG. 4 is a side view of the cap of FIG. 3.
Figure 5:
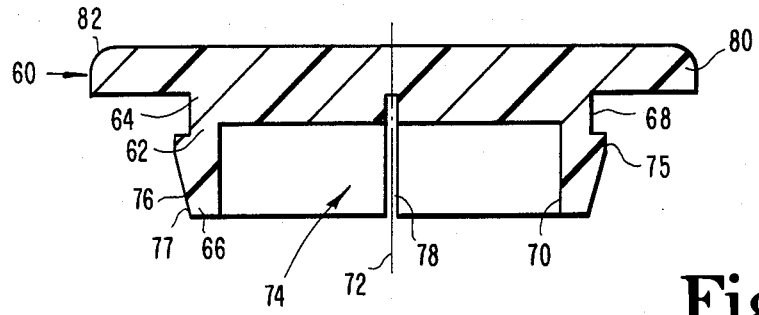
FIG. 5 is a cross-sectional view along lines 5—5 of FIG. 3.

Referring to FIGS. 3–10, there is illustrated a cap 60 which is inserted into anchoring plate 20 to secure the roofing membrane 58 (FIGS. 9 and 10) to anchoring plate 20. Referring more particularly to FIGS. 3–5, a cap 60 of a first embodiment is illustrated. Cap 60 consists of a resilient cylindrical body 62 having a top end 64 and bottom end 66. Cylindrical body 62 has an outer wall 68 and an inner wall 70. Cylindrical body 62 has a longitudinal axis 72 about which inner wall 70 defines a concentric downwardly opening cylindrical cavity 74. Attached to the bottom end 66 is a V-shaped flange 76 which extends radially beyond the outer wall 68 around the entire circumference of cylindrical body 62. V-shaped flange 76 tapers inwardly from its top 75 to its bottom 77. A plurality of compression cuts 78 extend through the cylindrical body and the V-shaped flange 76. Attached to the top end 64 of the cylindrical body 62 is a disk 80 which has an outside diameter 99 (FIG. 11) greater than the greatest diametrical dimension 97 of cylindrical body 62 and V-shaped flange 76. This disk 80 may be constructed with the radiused corners 82.

Figure 6:
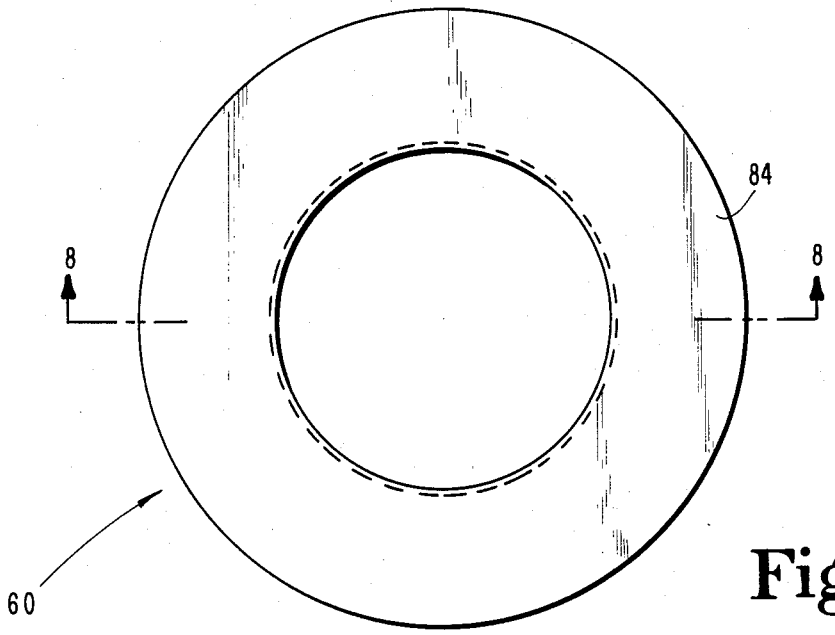
FIG. 6 is a top view of a second cap in accordance with the present invention.
Figure 7:
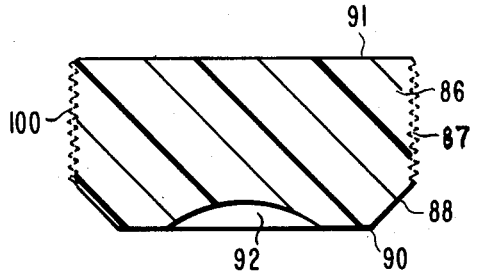
FIG. 7 is a cross-sectional view of a plug to be used with the cap of FIG. 6.
Figure 8:
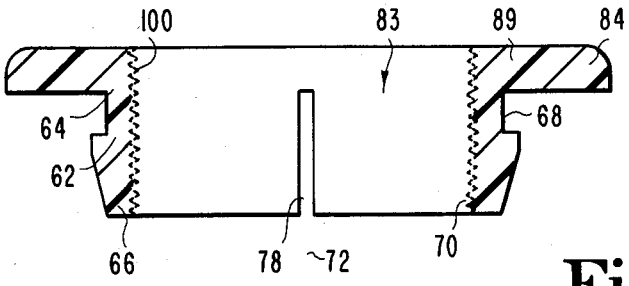
FIG. 8 is a cross-sectional view of the cap of FIG. 6.

Referring to FIGS. 6–8, there is illustrated a second embodiment, which at present is believed to be the preferred embodiment, of a cap 60 in accordance with the present invention. This cap also has a resilient cylindrical body 62 with a top end 64 and a bottom end 66 as well as an outer wall 68, an inner wall 70 and a longitudinal axis 72. However, this cap differs in that downwardly opening cylindrical cavity is also an upwardly opening cylindrical cavity 83 which is concentric about longitudinal axis 72. Since the cavity extends through what was the disk 80 in the first embodiment, in the second embodiment, there is a ring 84 attached to the top end 64 of the resilient cylindrical body 62. Additionally, there is a plug 86 sized to fit within the cylindrical cavity 83.

The plug 86 has a taper 88 near the bottom 90 of the side walls 87 to ease the insertion of the plug into the cylindrical cavity 83. Additionally, in the bottom 90, there is a recess 92 of sufficient size to accommodate the head of the linear fastener 54. The plug 86 is of a length sufficient to allow the top surface 91 to be flush with the top surface 89 of ring 84 when the plug is inserted into cap 60 as is best illustrated in FIG. 10.

Figure 9:
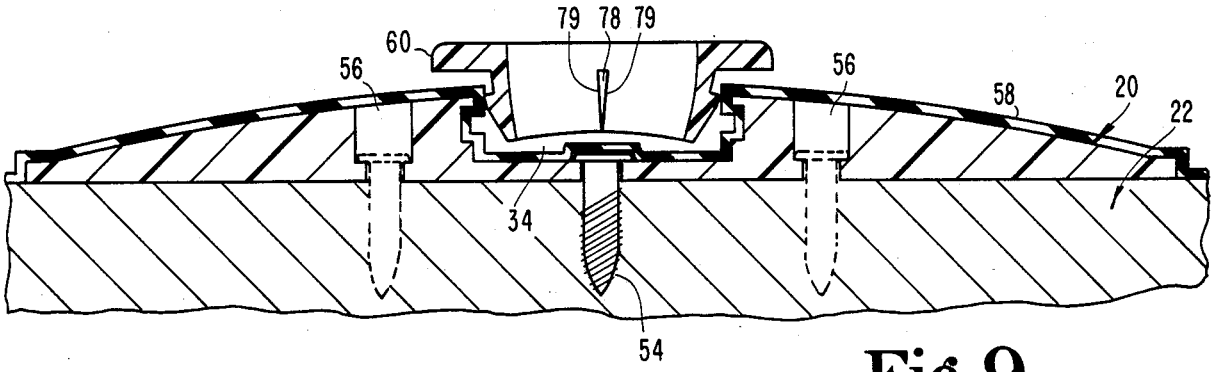
FIG. 9 is a cross-sectional view of the system described in the present invention during insertion of the cap into the anchoring plate.
Figure 10:
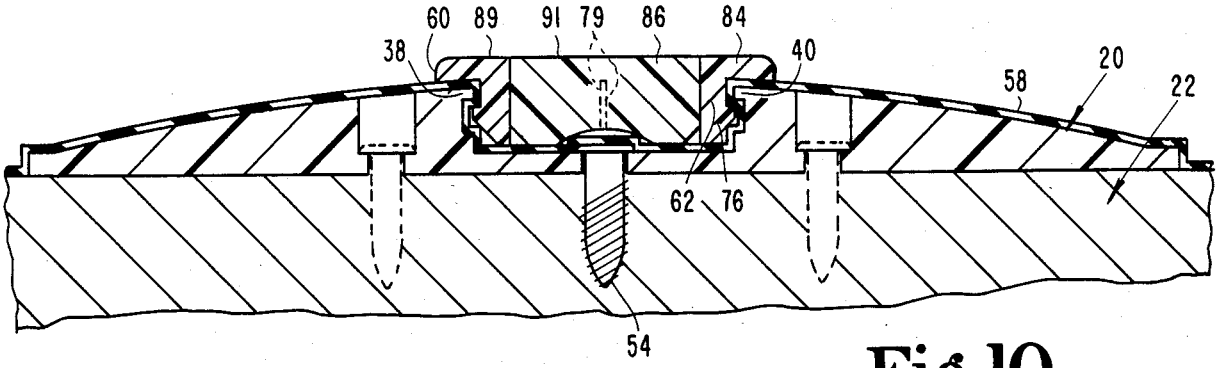
FIG. 10 is a cross-sectional view of one embodiment of the present invention when the roofing membrane is completely anchored to the structure.
Figure 11:
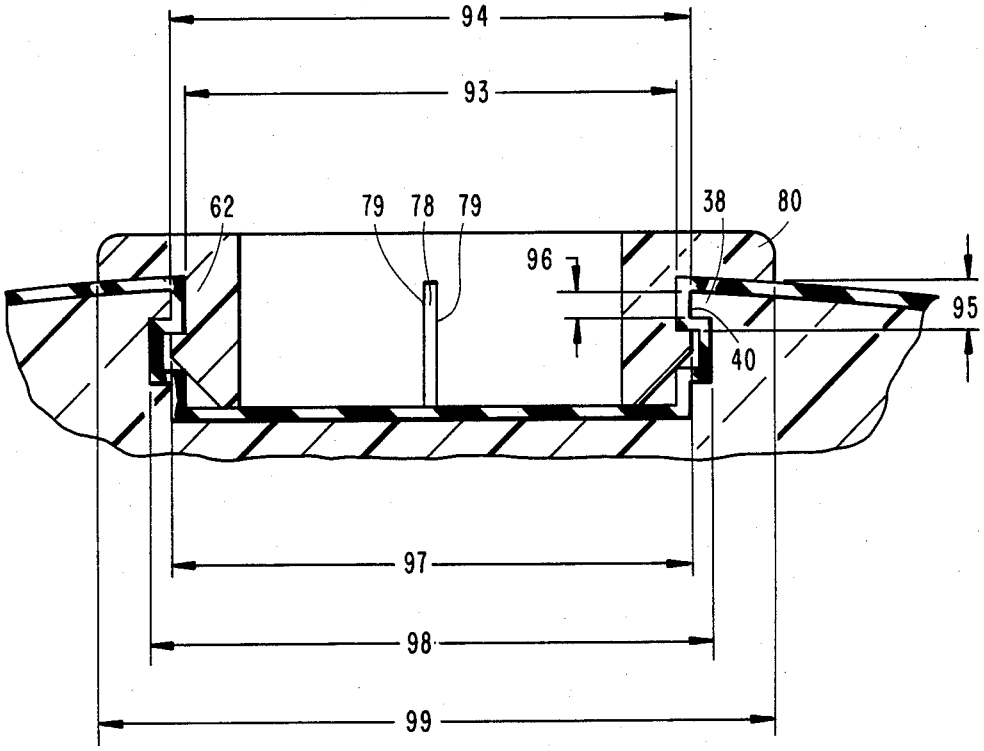
FIG. 11 is a blown-up view of a portion of FIG. 10.

The inter-relationship between the anchoring plate 20 and the cap 60 is best illustrated in FIGS. 9, 10 and 11. As can be seen from FIG. 11, the outside diameter 93 of cylindrical body 62 is slightly less than the inside diameter 94 of cylindrical side surface of lip 38. The distance 95 between the bottom of the disk 80 or ring 84 to the top of the V-shaped flange 76 is slightly greater than the thickness 96 of the lip 38. The greatest diametrical dimension 97 of the cylindrical body 62 and the V-shaped flange 76 is slightly less than the inside diameter 98 of axial opening 34. The outside diameter 99 of disk 80 or ring 84 is substantially greater than the inside diameter 94 of cylindrical side surface 40 of lip 38. These measurements are critical in order for the anchoring system to function properly. The utility of the compression cut 78 is best illustrated in FIGS. 9 and 10. Compression cut 78 is designed to allow the cylindrical body 62 of cap 60 to assume a first state illustrated in FIGS. 8, 4, 5, 10 and 11 wherein the sides 79 of the cut are parallel to one another. Additionally, the cap 60 can assume a second state best illustrated in FIG. 9 wherein the sides 79 of the cylindrical compression cut 78 converge toward bottom end 66 of the resilient cylindrical body 62. In the second state, the greatest diametrical dimension 97 of cylindrical body 62 and V-shaped flange 76 is diminished to be slightly less than the inside diameter 94 of cylindrical side surface 40 of lip 38. This allows for the cap 60 to be inserted into anchoring plate 20 after membrane 58 has been extended across the anchoring plate 20 and inserted into axial opening 34. Once the cap 60 is completely inserted into axial opening 34, the cylindrical body 62 resumes its first state and the sides 79 of the compression cut 78 are once again parallel (as illustrated by the dotted lines in FIG. 10) and the top of V-shaped flange 76 is received in channel 48. At this time, if the second embodiment of cap 60 is used, plug 86 may be inserted into cylindrical cavity 83 and thereby lock cylindrical body 62 into the first state so that the cap 60 cannot be inadvertently knocked out of the anchoring plate 20. Plug 86 and cylindrical cavity 83 may be designed so that plug 86 is driven into cylindrical cavity 83 or so that either or both plug 86 and cylindrical cavity 83 will have threads 100 which will allow the plug 86 to be screwed into cylindrical cavity 83. These threads 100 are illustrated by the dotted lines in FIGS. 7 and 8, while a smooth sided plug 86 and cylindrical cavity 83 are illustrated in the remainder of the drawings illustrating the second embodiment of cap 60. As can be seen from FIGS. 9 and 10, the use of compression cut 78 and of the particular design of both the anchoring plate 20 and caps 60 allows the membrane 58 to be secured to the anchoring plate 20 which is secured to the structure 22 without membrane 58 being penetrated in any way so that the water-tight integrity of membrane 58 is maintained.

FIG. 10 best illustrates that the anchoring system of the present invention is very low profile and therefore cannot be easily damaged by workers walking on the roof after or during installation. Anchor plate 20, because of radiused top surface 28, results in only slight and gradual deviation of the roof surface. Cap 60 does not protrude greatly beyond the roof membrane as only the thin ring 84 or disk 80 of cap 60 is not received within axial opening 34. Because so little of cap 60 protrudes above roofing membrane 58, there is very little chance that a blow sufficient to dislodge cap 60 could be administered by the foot of a worker walking on the roof.

It is envisioned that cap 60 and anchoring plate 20 may be manufactured or molded from a wide variety of materials. One material which is envisioned is a hard plastic because it is sufficiently flexible to be compressed, through the use of compression cuts 78, into the second state, yet rigid enough that once cap 60 and anchoring plate 20 are snapped together there will be secured attachment of roofing membrane 58 to structure 22.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A roof membrane anchoring system for securing a roof membrane to a structure, comprising:

an anchoring plate attachable to the structure, said anchoring plate comprising:

a first disk having a substantially planar bottom surface and a convexly radiused top surface, said top surface having a cylindrical axial opening at the center of said first disk, said cylindrical axial opening having a lower surface and a first inside diameter;

a lip extending radially into said cylindrical axial opening from said radiused top surface, said lip having a ring-shaped bottom surface and a cylindrical side wall extending between said ring-shaped bottom surface and said radiused top surface, said cylindrical side wall having a second inside diameter less than said first inside diameter, said lip having a thickness defined by the linear distance between said ring-shaped bottom surface and said radiused top surface; and, a flange extending radially into said cylindrical axial opening from said lower surface and defining a first channel with said ring-shaped bottom surface of said lip and said cylindrical axial opening;

attachment means for attaching said anchoring plate to said structure;

a cap for securing the roof membrane to said anchoring plate by inserting the roof membrane in said cylindrical axial opening and snapping said cap in said cylindrical axial opening thereby interlocking said cap and said anchoring plate, said cap comprising:

a cylindrical body having a top end, a bottom end, an outer wall, an inner wall and a longitudinal axis, said inner wall defining a downwardly opening cylindrical cavity concentric about said longitudinal axis, said outer wall having a first outside diameter;

a V-shaped flange tapering inwardly from a top to a bottom attached to the bottom end of said cylindrical body and extending radially beyond said outer wall around the entire circumference of said cylindrical body, said V-shaped flange and said cylindrical body having a greatest diametrical dimension at said top;

a compression cut extending longitudinally through the cylindrical body and the V-shaped flange said compression cut having sides;

a second disk attached to the top end of said cylindrical body and concentric about said longitudinal axis, said second disk having a second outside diameter greater than the greatest diametrical dimension of said cylindrical body and said V-shaped flange; and, said cap having a first state wherein said greatest diametrical dimension is slightly greater than said second inside diameter and slightly less than said first inside diameter and wherein said first outside diameter is slightly less than said second inside diameter, said cap also having a second state wherein said greatest diametrical dimension is slightly less than said second inside diameter.

2. The invention of claim 1 wherein said cap includes a plurality of compression cuts extending longitudinally through the cylindrical body and the V-shaped flange.

3. The invention of claim 2 wherein said cap assumes the first state when it is not subject to any compression forces and assumes the second state when said cap is subject to the compression forces of inserting the cap in the anchoring plate and said cap resumes said first state when inserted in the anchoring plate.

4. The invention of claim 3 wherein said second disk, said outside wall and said V-shaped flange define a second channel which has a width slightly greater than the thickness of said lip of said anchoring plate, said lip being received in said second channel when said cap is inserted in said anchoring plate.

5. The invention of claim 4 wherein said V-shaped flange is sized to fit within said first channel of said anchoring plate when said cap is inserted in said anchoring plate.

6. The invention of claim 1 wherein said downwardly opening cylindrical cavity extends through said second disk to also be upwardly opening and said cap further comprises a cylindrical plug sized to securely fit within said cylindrical cavity.

7. The invention of claim 6 wherein said plug is threadingly engaged within said cylindrical cavity when inserted in said cylindrical cavity.

8. The invention of claim 6 wherein said cap assumes the first state when it is not subject to any compression forces and assumes the second state when said cap is subject to the compression forces of inserting the cap in the anchoring plate and said cap resumes said first state when inserted in the anchoring plate.

9. The invention of claim 8 wherein said cylindrical body is lockable in said first state when said plug is inserted in said cylindrical cavity.

10. The invention of claim 9 wherein said plug is threadingly engaged within said cylindrical cavity when inserted in said cylindrical cavity.

11. The invention of claim 9 wherein said second disk, said outside wall and said V-shaped flange define a second channel which has a width slightly greater than the thickness of said lip of said anchoring plate, said lip being received in said second channel when said cap is inserted in said anchoring plate.

12. The invention of claim 11 wherein said V-shaped flange is sized to fit within said first channel of said anchoring plate when said cap is inserted in said anchoring plate.

13. The invention of claim 9 wherein said cap includes a plurality of compression cuts extending longitudinally through the cylindrical body and the V-shaped flange.

14. The invention of claim 13 wherein said V-shaped flange is sized to fit within said first channel of said anchoring plate when said cap is inserted in said anchoring plate.

15. The invention of claim 1 wherein said attachment means includes an attachment hole extending through said first disk from said top surface to said bottom surface and a linear fastener of appropriate design for the structure to which the anchoring plate is to be attached.

16. The invention of claim 15 wherein said attachment hole is axial.

17. The invention of claim 15 wherein there are a plurality of attachment means.

18. A roof membrane anchoring system for securing a roof membrane to a structure, comprising:

an anchoring plate attachable to the structure, said anchoring plate comprising:

a first disk having a substantially planar bottom surface and a convexly radiused top surface, said top surface having a cylindrical axial opening at the center of said first disk, said cylindrical axial opening having a lower surface and a first inside diameter;

a lip extending radially into said cylindrical axial opening from said radiused top surface, said lip having a side wall, said side wall having a second inside diameter less than said first inside diameter; and, a flange extending radially into said cylindrical axial opening from said lower surface and defining a first channel with said lip and said cylindrical axial opening;

attachment means for attaching said anchoring plate to said structure, said attachment means including an attachment hole extending through said first disk from said top surface to said bottom surface and a linear fastener of appropriate design for the structure to which the anchoring plate is to be attached;

a cap for securing the roof membrane to said anchoring plate by inserting the roof membrane in said cylindrical axial opening and snapping said cap in said cylindrical axial opening thereby interlocking said cap and said anchoring plate, said cap comprising:

a cylindrical body having a top end, a bottom end, an outer wall, an inner wall and a longitudinal axis, said inner wall defining a downwardly opening cylindrical cavity concentric about said longitudinal axis, said outer wall having a first outside diameter;

a V-shaped flange tapering inwardly from a top to a bottom attached to the bottom end of sad cylindrical body and extending radially beyond said outer wall around the entire circumference of said cylindrical body, said V-shaped flange and said cylindrical body having a greatest diametrical dimension at said top, said V-shaped flange being sized to be receivable in said channel of said anchoring plate;

a compression cut extending longitudinally through the cylindrical body and the V-shaped flange;

a second disk attached to the top end of said cylindrical body and concentric about said longitudinal axis, said second disk having a second outside diameter greater than the greatest diametrical dimension of said cylindrical body and said V-shaped flange; and, said cap having a first state wherein said greatest diametrical dimension is slightly greater than said second inside diameter and slightly less than said first inside diameter and wherein said first outside diameter is slightly less than said second inside diameter, said cap also having a second state wherein said greatest diametrical dimension is slightly less than said second inside diameter.

19. A roof membrane anchoring system for securing a roof membrane to a structure, comprising:

an anchoring plate attachable to the structure, said anchoring plate comprising:

a a substantially planar bottom surface; and, a smoothly contoured top surface, said top surface having an opening therein for the receipt of a roofing membrane;

a cap designed and arranged to be received into the opening in said anchoring plate without penetrating a membrane which has been received in the opening;

a plug insertable into said cap, said plug being designed and arranged to lock said cap within said opening in said anchoring plate; and, attachment means for attaching said anchoring plate to the structure.

20. The invention of claim 19 wherein said cap has a cavity extending therethrough with an interior surface having interruptions therein.

* * * * *